United States Patent [19]

Hayashi

[11] 4,415,059

[45] Nov. 15, 1983

[54] MUFFLER

[75] Inventor: Yoshimasa Hayashi, Kamakura, Japan

[73] Assignee: Nissan Motor Company, Yokohama, Japan

[21] Appl. No.: 389,267

[22] Filed: Jun. 17, 1982

[30] Foreign Application Priority Data

Jul. 22, 1981 [JP] Japan ..... 56-114888

[51] Int. Cl.[3] ..... F01N 1/02

[52] U.S. Cl. ..... 181/250; 181/272; 181/273

[58] Field of Search ..... 181/249, 250, 272, 273, 181/211, 227, 255

[56] References Cited

U.S. PATENT DOCUMENTS

| | | | |
|---|---|---|---|
| 1,426,352 | 8/1922 | Brush | 181/255 |
| 1,656,629 | 1/1928 | Gray | 181/211 |
| 2,184,891 | 12/1939 | Bourne | 181/273 |
| 2,580,564 | 1/1952 | Ludlow | 181/250 |
| 3,104,734 | 9/1963 | Ludlow et al. | 181/227 |
| 3,648,803 | 3/1972 | Heath et al. | 181/250 |

FOREIGN PATENT DOCUMENTS 336714 10/1930 United Kingdom .

*Primary Examiner*—Benjamin R. Fuller

*Attorney, Agent, or Firm*—Schwartz, Jeffery, Schwaab, Mack, Blumenthal & Koch

[57] ABSTRACT

An inner shell having aligned first and second expansion chambers is spacedly disposed in an outer shell in a manner to define therebetween four isolated chambers upstreamly positioned two of which surround the first expansion chamber and downstreamly positioned two of which surround the second expansion chamber. The first expansion chamber is connected through respective flanged openings to the upstreamly positioned isolated chambers to allow these chambers to show a sound damping effect. The upstream and downstream portions of the second expansion chamber are connected through respective groups of perforations to the downstreamly positioned isolated chambers to allow these chambers to show a sound damping effect.

7 Claims, 4 Drawing Figures

MUFFLER

BACKGROUND OF THE INVENTION

The present invention relates to a sound damping device for damping the sounds produced by sound sources, and more particularly to a muffler for reducing the noise of the combustion and exhaust of an internal combustion engine or the like.

SUMMARY OF THE INVENTION

It is an object of the present invention to provide a muffler which can not only damp the combustion and exhaust sounds of the internal combustion engine, but also damp the noise produced in the muffler.

It is another object of the present invention to provide a muffler of which exhaust resistance is small.

According to the present invention, there is provided a muffler which comprises an inner shell having first and second expansion chambers which are coaxially arranged and connected to each other through a communicating passage; an outer shell spacedly covering the inner shell to define therebetween first, second, third and fourth isolated chambers, the first and second isolated chambers surrounding the first expansion chamber, while, the third and fourth isolated chambers surrounding the second expansion chamber; first means connecting the first expansion chamber with the first isolated chamber to allow the latter to show a sound damping effect; second means connecting the first expansion chamber with the second isolated chamber to allow the latter to show a sound damping effect; third means connecting the upstream and downstream portions of the second expansion chamber with the third isolated chamber to allow the latter to show a sound damping effect; fourth means connecting the upstream and downstream portions of the second expansion chamber with the fourth isolated chamber to allow the latter to show a sound damping effect; an inlet means leading to the first expansion chamber to introduce thereinto an exhaust issued from a noise source; and outlet means extending from the second expansion chamber to the open air to discharge the exhaust in the second expansion chamber into the atmosphere.

BRIEF DESCRIPTION OF THE DRAWINGS

Other objects and advantages of the present invention will become clear from the following description when taken in conjunction with the accompanying drawings, in which.

DESCRIPTION OF THE PRIOR ART

Prior to describing the muffler of the invention, a conventional muffler for an internal combustion engine will be described with reference to FIG. 1 in order to clarify the invention.

Figure 1:
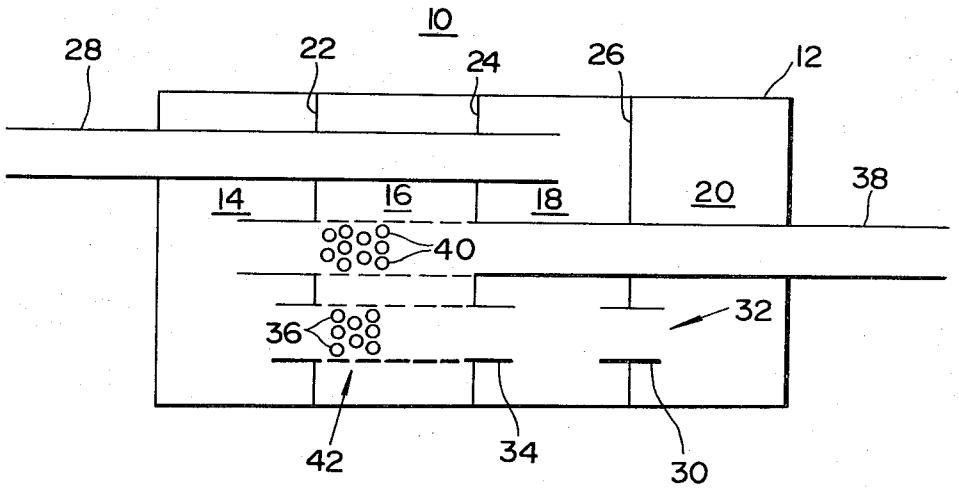
FIG.1 PRIOR ART
FIG. 1 is a schematic illustration of a conventional muffler.

The conventional muffler 10 shown in FIG. 1 comprises generally a shell 12 of which interior is divided into four chambers 14, 16, 18 and 20 by three partition walls 22, 24 and 26. An exhaust gas inlet tube 28 from the exhaust manifold of an internal combustion engine (not shown) leads to the chamber 18, so that the chamber 18 acts as a first expansion chamber. The first expansion chamber 18 and the chamber or resonance chamber 20 are connected through a first communicating pipe 30 supported by the partition wall 26, so that the interior of the pipe 30 and the chamber 20 constitute a so-called Helmholz's resonator 32 which primarily affects low frequency sounds. A second communicating pipe 34 connects the first expansion chamber 18 to the chamber 14 to allow the latter to act as a second expansion chamber. The pipe 34 is formed with a plurality of perforations 36 through which the interior of the pipe 34 and the chamber or resonance chamber 16 are communicated. An exhaust gas outlet pipe 38 extends from the second expansion chamber 14 to the atmosphere, extending across the chambers 16, 18 and 20, as shown. The pipe 38 is formed with a plurality of perforations 40 through which the interior of the pipe 38 is communicated with the resonance chamber 16. The chamber 16 and the perforations 36 thus constitute, as a whole, a resonator 42 which primarily affects high frequency sounds.

However, in practical use, the muffler of the above type has a tendency of producing a considerable noise due to its inherent construction. Experiment has revealed that the noise is caused by vibration of the shell 12 and that the vibration is mainly caused by the pulsating exhaust gas successively rushed into the first expansion chamber 18. In fact, the noise generated by the vibrating shell 12 is freely transmitted to the open air because of absence of any means which suppresses the vibration of the shell 12. One measure to solve this drawback is to increase the mechanical strength of the shell 12 by increasing the thickness thereof. However, this measure induces inevitably a heavier and higher cost construction of the muffler and thus, the measure is not practical.

Furthermore, the muffler of the above-mentioned type exhibits a high exhaust resistance because of looped ways of the exhaust gas in the muffler. As is known, the high exhaust resistance will reduce power and fuel economy of the engine.

DESCRIPTION OF THE INVENTION

Therefore, to solve the above-mentioned drawbacks is an essential object of the present invention.

Figure 2:
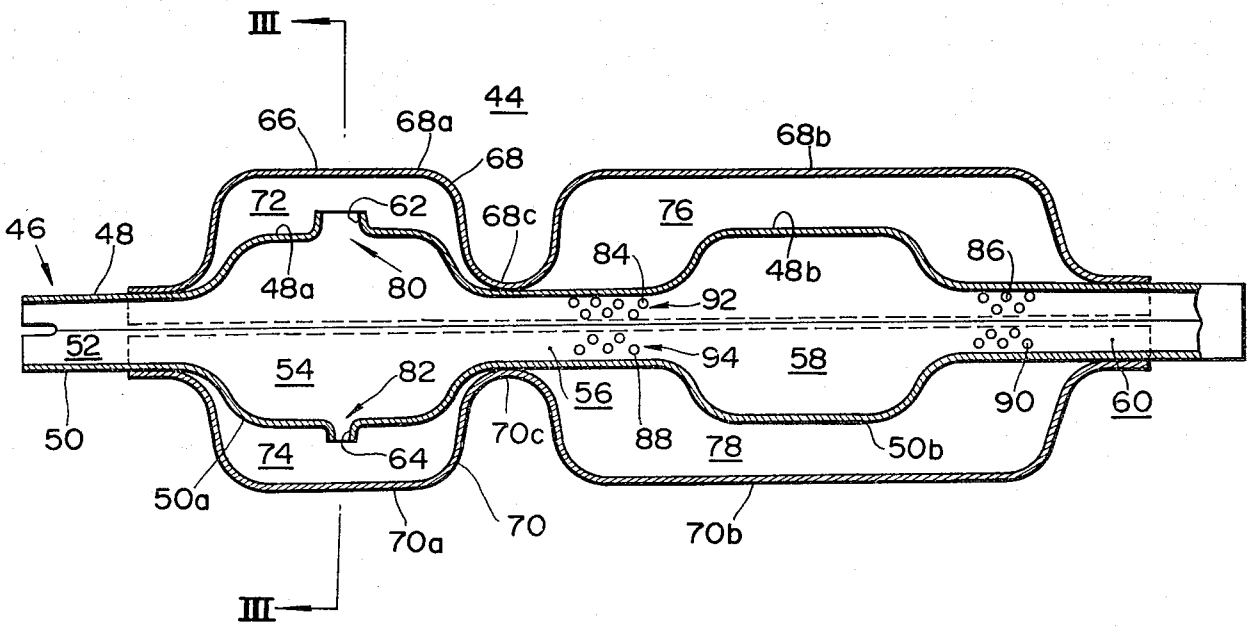
FIG. 2 is a longitudinally sectioned view of a muffler according to the present invention.
Figure 3:
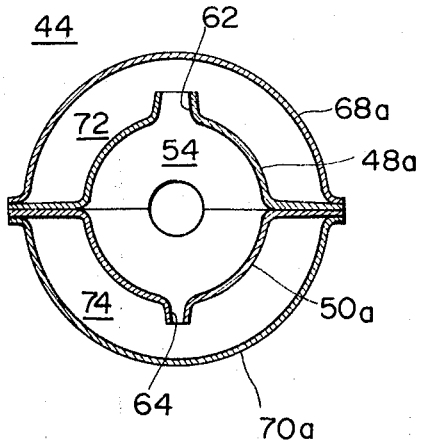
FIG. 3 is a laterally sectioned view of the muffler of the invention, which is taken along the line III—III of FIG. 2.

Referring to FIGS. 2 and 3, especially FIG. 2, there is shown a first embodiment of the present invention. The muffler 44 of this embodiment comprises an elongate inner shell 46 including two elongate dish-shaped plates 48 and 50, each having two swelled portions 48*a* and 48*b* (or 50*a* or 50*b*). The two plates 48 and 50 are coupled with each other to define in the inner shell 46 thus formed a first communicating passage 52, a first enlarged chamber 54, a second communicating passage 56, a second enlarged chamber 58 and a third communicating passage 60 which are coaxially arranged in this order, as shown. The first enlarged chamber 54 is connected through the first communicating passage 52 to the exhaust manifold of an internal combustion engine (not shown), so that the first enlarged chamber 54 functions as a first expansion chamber. The swelled portions 48*a* and 50*a* of the plates 48 and 50 are formed with respective flanged openings 62 and 64 which face each other. The passages thus defined by the respective flanged openings 62 and 64 extend perpendicular to the longitudinal axis of the inner shell 46. The second enlarged chamber 58 connected through the second communicating passage 56 to the first expansion chamber 54 functions as a second expansion chamber. The second expansion chamber 58 is communicated with the atmosphere through the third communicating passage 60.

The inner shell 46 is spacedly and tightly disposed in an elongate outer shell 66 which includes two elongate dish-shaped plates 68 and 70, each having two swelled portions 68*a* and 68*b* (or 70*a* and 70*b*). As will be understood from FIG. 3, each of the inner and outer shell plates 48, 50, 68 and 70 has a flange (no numeral) throughout the peripheral portion thereof. The coupling between the associated plates is made by mating and welding the associated flanges of them by employing a seam-welding technique. The inwardly recessed portions 68*c* and 70*c* of the outer shell plates 68 and 70 contact with the associated portions of the inner shell plates 48 and 50, so that first, second, third and fourth cavities 72, 74, 76 and 78 are defined between the associated swelled portions 68*a* and 48*a*, 70*a* and 50*a*, 68*b* and 48*b*, and 70*b* and 50*b*, respectively. The first and second cavities 72 and 74 are communicated with the first expansion chamber 54 through the respective flanged openings 62 and 64, so that the first cavity 72 and the passage of the flanged opening 62 constitute a first resonator 80, while, the second cavity 74 and the passage of the flange opening 64 constitute a second resonator 82. The volume V of each cavity 72 or 74, the sectional area S of each flanged opening 62 or 64 and the axial length l of the same are so determined as to damp sounds having a predetermined low frequency level f ($f=(C/2\pi)\sqrt{(S/Vl)}$, where; c=sound velocity). The inner shell plate 48 is formed at the second and third communicating passages 56 and 60 with a plurality of perforations 84 and 86 through which the third cavity 76 is communicated with the interior of the inner shell 46. Similar to this, the other inner shell plate 50 is formed at the second and third communicating passages 56 and 60 with a plurality of perforations 88 and 90 through which the fourth cavity 78 is communicated with the interior of the inner shell 46. With this construction, the third and fourth cavities 76 and 78 function as first and second resonance chambers, respectively. The perforations 84 and 86 and the first resonance chaber 76 thus constitute a third resonator 92, and the perforations 88 and 90 and the fourth resonance chamber 78 constitute a fourth resonator 94. The sectional area of each perforation 84 or 86 is different from that of the perforation 88 or 90, so that the third and fourth resonators 92 and 94 affect sounds having different high frequencies.

In the following, operation of the muffler 44 of the invention will be described.

The exhaust gas from the engine (not shown) is, first, introduced or rushed into the first expansion chamber 54 where the gas is suddenly expanded to reduce the vibration energy thereof. The predetermined low frequency sounds are removed or at least reduced by the first and second resonators 80 and 82. The exhaust gas is then introduced through the second communicating passage 56 into the second expansion chamber 58 where the gas is expanded again to reduce the vibration energy thereof to its minimum level. The gas is then discharged into the atmosphere through the third communicating passage 60. During flowing through the second and third communicating passages 56 and 60, the exhaust gas loses the predetermined high frequency sounds by the third and fourth resonators 92 and 94. With this manner, the combustion and exhaust sounds or noises are damped sufficiently.

In the muffler 44 of the present invention, the following desirable effect is achieved which is not expected from the conventional muffler as described hereinabove.

Similar to the conventional muffler, the pulsating and rushing exhaust gas from the engine forces the inner shell plates 48 and 50 to vibrate at a certain level producing a considerable noise at that portion. However, in the invention, such noise is not directly transmitted to the outside of the muffler 44 because of the presence of the chambers 72, 74, 76 and 78 which surround the inner shell 46. In fact, these chambers function as a noise damper.

Figure 4:
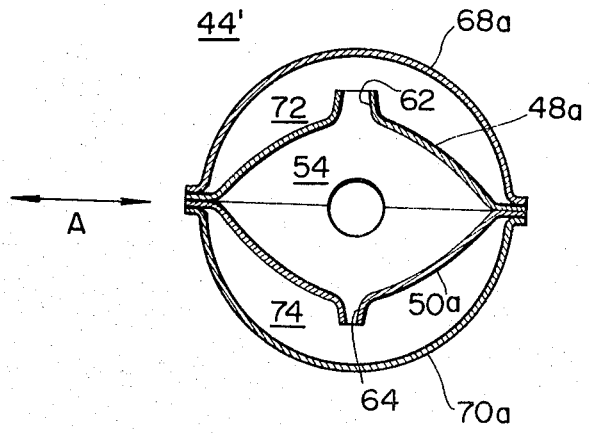
FIG. 4 is a laterally sectioned view of a modification of the muffler of FIG. 2, which is taken along a line corresponding to the line III—III of FIG. 2.

Referring to FIG. 4, there is shown a modification 44' of the muffler according to the present invention, in which similar parts to those of the above-mentioned muffler 44 are designated by the same numerals. The view of this drawing is taken along a line located at a portion corresponding the portion where the line III—III of FIG. 2 is located. As is seen from the drawing, the muffler 44' of this modification features that the swelled portions 48*a* and 50*a* of the inner shell 46 are formed somewhat depressed as compared with those of FIG. 3. With the depressed configuration of them, the stiffness of the muffler 44' against the vibration in the direction of the arrow A is improved. Thus, in this modified muffler 44', the noise damping effect is much more improved.

As is described hereinabove, in the present invention, the inner shell into which the exhaust gas from the engine is rushed is enclosed by a so-called noise damping means which comprises the sound damping chambers 72, 74, 76 and 78. Thus, the noise produced by the vibrating inner shell 46 is not directly transmitted to the outside of the muffler. Furthermore, the aligned arrangement among the first communicating passage 52, the first expansion chamber 54, the second communicating passage 56, the second expansion chamber 58 and the third communicating passage 60 reduces the exhaust resistance of the muffler.

What is claimed is:

1. A muffler comprising:

an inner shell having first and second expansion chambers which are coaxially arranged and connected to each other through a communicating passage;

an outer shell spacedly covering said inner shell to define therebetween first, second, third and fourth isolated chambers, said first and second isolated chambers surrounding said first expansion chamber, while, said third and fourth isolated chambers surrounding said second expansion chamber;

first means connecting said first expansion chamber with said first isolated chamber to allow the latter to show a sound damping effect;

second means connecting said first expansion chamber with said second isolated chamber to allow the latter to show a sound damping effect;

third means connecting the upstream and downstream portions of said second expansion chamber with said third chamber to allow the latter to show a sound damping effect;

fourth means connecting the upstream and downstream portions of said second expansion chamber with said fourth chamber to allow the latter to show a sound damping effect;

an inlet means leading to said first expansion chamber to introduce thereinto an exhaust issued from a noise source; and an outlet means extending from said second expansion chamber to the open air to discharge the exhaust in the second expansion chamber into the atmosphere.

2. A muffler as claimed in claim 1, in which said first and second means are respective flanged openings formed in a swelled portion of said inner shell in which portion said first expansion chamber is defined.

3. A muffler as claimed in claim 2, in which the axes of said flanged openings are generally perpendicular to the axis of the inner shell.

4. A muffler as claimed in claim 2, in which said third and fourth means are two groups of perforations which are respectively formed in tubular portions of said inner shell between which said second expansion chamber is located.

5. A muffler as claimed in claim 4, in which a resonator thus constructed by said first isolated chamber and one of said flanged openings and another resonator thus constructed by said second isolated chamber and the other flanged opening affect primarily sounds having different frequencies.

6. A muffler as claimed in claim 5, in which a resonator thus constructed by said third isolated chamber and one group of the perforations and another resonator thus constructed by said fourth isolated chamber and the other group of the perforations affect primarily sounds having different frequencies.

7. A muffler as claimed in claim 1, in which said inlet and outlet means are communicating passages defined within respective tubular portions of said inner shell, and in which said tubular portions and said first and second expansion chambers are arranged on a common axis.

* * * * *